United States Patent [19]

Young et al.

[11] Patent Number: 5,026,438

[45] Date of Patent: Jun. 25, 1991

[54] METHOD OF MAKING SELF-ALIGNING ANISOTROPIC POWDER FOR MAGNETS

[75] Inventors: Kevin A. Young, Fairmount; Dennis L. Plackard, Alexandria, both of Ind.

[73] Assignee: General Motors Corporation, Detroit, Mich.

[21] Appl. No.: 417,540

[22] Filed: Oct. 5, 1989

Related U.S. Application Data

[63] Continuation-in-part of Ser. No. 219,551, Jul. 14, 1988, abandoned.

[51] Int. Cl.[5] ..... H01F 41/02

[52] U.S. Cl. ..... 148/101; 148/105; 29/608

[58] Field of Search ..... 148/101, 104, 105; 29/608

[56] References Cited

U.S. PATENT DOCUMENTS

| | | | |
|---|---|---|---|
| 4,558,077 | 12/1985 | Gray | 148/103 |
| 4,832,891 | 5/1989 | Kass | 29/608 |
| 4,842,656 | 6/1989 | Maines et al. | 148/105 |
| 4,853,045 | 8/1989 | Rozendaal | 148/1104 |
| 4,854,979 | 8/1989 | Wecker | 148/104 |
| 4,897,607 | 1/1990 | Yang et al. | 148/101 |

*Primary Examiner*—R. Dean
*Assistant Examiner*—George Wyszomierski
*Attorney, Agent, or Firm*—Lawrence B. Plant

[57] ABSTRACT

A method is provided for comminuting and mechanically magnetically orienting particles of hot worked rare earth-transition metal-boron alloy to make bonded anistropic magnets. The method involves comminuting a hot-worked body of the alloy to form platelet shaped particles, and applying pressure to the particles in a die in the absence of an external magnetic field.

12 Claims, 1 Drawing Sheet

METHOD OF MAKING SELF-ALIGNING ANISOTROPIC POWDER FOR MAGNETS

CROSS REFERENCE TO RELATED APPLICATIONS

This is a continuation-in-part of U.S. patent application Ser. No. 07/219,551 filed July 14, 1988, and assigned to the assignee of this application now abandoned.

This invention relates to a method of making a self-aligning powder for magnets comprising hot worked rare earth-transition metal-boron compositions which are ground to suitably sized and shaped particles. These particles are mechanically aligned without an applied magnetic field to make magnets with a high degree of magnetic anisotropy. The aligned particles can be readily bonded together with a suitable binder or hot pressed to full density.

BACKGROUND OF THE INVENTION

Permanent magnets based on rare earth-transition metal-boron (RE-TM-B) compositions containing iron and neodymium and/or praseodymium are now known and in commercial usage. Such permanent magnets contain as an essential magnetic phase grains of tetragonal crystals in which the proportions of iron, neodymium and boron (for example) are exemplified by the empirical formula $Nd_2Fe_{14}B$. These $RE_2TM_{14}B$ magnet compositions and methods for making them are described in U.S. Pat. No. 4,802,931, assigned to the assignee of this application. The grains of the magnetic phase are surrounded by a second phase that is typically neodymium-rich as compared with the essential magnetic phase. It is known that magnets based on such compositions may be prepared by rapidly solidifying a melt of the composition to produce fine grained, magnetically isotropic platelets of ribbon-like fragments. Magnets may be formed from these isotropic particles by practices which are known and which will be discussed further herein.

Melt spinning is an efficient method of producing rapidly solidified particles of iron-neodymium-boron compositions. The melt-spun particles, either as is or after a suitable anneal, are magnetically isotropic and have high coercivity at room temperature. They may be used to make resin bonded magnets that are magnetically isotropic. The isotropic powder has many useful applications, but there is also a need for an anisotropic powder with a coercivity of at least 1,000 Oersted at room temperature.

It is also known that iron-neodymium-boron permanent magnets can be prepared starting with cast ingots or atomized powder of suitable compositions. The ingots or powder are comminuted to form micron-size (e.g., 1 to 15 microns) powder. These particles are magnetically anisotropic. They are aligned in a suitable magnetic field, compacted into magnet bodies and sintered to form permanent magnets.

When iron-neodymium-boron ingots are pulverized, the resulting powder is magnetically anisotropic, but it has little coercivity. Similarly, if a melt is atomized by conventional atomization techniques, such powder is magnetically anisotropic but has little coercivity. It is only after such powder has been compacted and sintered that the magnets display any appreciable coercivity. Workers have attempted to pulverize such anisotropic permanent magnets in order to obtain a coercive anisotropic permanently magnetic powder. Unfortunately, however, pulverization of the permanent magnet bodies yields a powder that has little coercivity.

It is known that rapidly quenched isotropic powder such as particles of melt spun ribbon can be suitably hot pressed and/or hot worked and plastically deformed to form high strength anisotropic permanent magnets. This practice is described in U.S. Pat. No. 4,792,367, assigned to the assignee of this application. Such magnets have excellent magnetic properties. U.S. Pat. No. 4,842,656, assigned to the assignee of this application, discloses how such rapidly solidified and further hot worked anisotropic alloy (unlike finely ground, oriented and sintered) can be comminuted, aligned in a magnetic field and bonded to make high coercivity anisotropic permanent magnets.

While excellent bonded magnets can be made from particles of magnetically anisotropic, hot pressed and/or hot worked alloy aligned in a magnetic field, it is the principal object of this invention to create like bonded magnets as well as fully dense hot pressed (i.e., binder-free) magnets from such magnetically anisotropic particles without application of a magnetic field in the particle consolidation step.

SUMMARY OF THE INVENTION

In general, our compositions suitably comprise, on an atomic percentage basis, 40 to 90 percent of iron or mixtures of cobalt and iron, 10 to 40 percent of rare earth metal that necessarily includes neodymium and/or praseodymium and at least one-half percent boron. Preferably, iron makes up at least 40 atomic percent of the total composition and neodymium and/or praseodymium make up at least 6 atomic percent of the total composition. Preferably, the boron content is in the range of 0.5 to 18 atomic percent of the total composition, but the total boron content may suitably be higher than this if permanent magnetic properties as defined herein are retained. It is preferred that iron make up at least 60 percent of the non-rare earth metal content. It is also preferred that neodymium and/or praseodymium make up at least 60 percent of the rare earth content.

We have found that we can make our magnetically anisotropic powder by starting with such a composition that has been suitably rapidly solidified to produce an amorphous material or a finely crystalline material in which the grain size is less than about 400 nanometers in the smallest dimension after hot working. We prefer, however, that the rapidly solidified material be amorphous or, if extremely finely crystalline, have a grain size smaller than about 20 nanometers. Such material may be produced, for example, by melt spinning.

Such rapidly solidified material is hot pressed in a die at temperatures on the order of 700° C. or higher and at a pressure and for a time to form a fully dense material that has magnetic coercivity at room temperature in excess of 1,000 Oersted and preferably in excess of 5,000 Oersted. Usually, when melt-spun material, finer than 20 nanometers in grain size, is heated at about 750° C. for a period of a minute or so and hot pressed to full density, the resultant body is a permanent magnet. Further, the magnetic body slightly magnetically anisotropic. If the particulate material has been held at the hot pressing temperature for a suitable period of time, it will then have a grain size preferably in the range of about 20 to 500 nanometers, preferably about 20 to 100 nanometers. If the hot pressed body is then hot worked, that is, plastically deformed at such an elevated temperature, to deform the grains without affecting an increase in grain size above 500 nanometers, the resultant product displays appreciable magnetic anisotropy, and it may have an energy product of about 30 MegaGaussOersted or higher.

When we speak of our powder composition as being magnetically anisotropic, it is meant that each particle has a preferred direction of magnetization. For $RE_2TM_{14}B$ alloys comprised predominantly of Nd and/or Pr as the RE and Fe as the TM, the preferred direction of magnetization is the crystallographic c-axis.

We have discovered that when such hot pressed or hot worked bodies are then comminuted (e.g., in an impact mill or disc grinder) to a powder, in a controlled manner, the particles of the powder have a platelet shape with a preferred direction of magnetization in the direction of applied pressure during hot working, i.e., the "thickness" of the particle, and normal to the planar surface of each platelet, i.e., the "face" of the particle. The crystallographic c-direction is also the shortest dimension of the crystals in rapidly solidified alloy after it is hot-worked to induce magnetic anisotropy and controlled grain growth. Our comminuted powder comprises particles in the size range of at least about 40 micron, and preferably about 50 to 150 microns, average along the shortest dimension of their faces. It is preferred that particle fines without a high ratio between the facial area and the thickness of the particles be minimized. Each powder particle contains many of the deformed and aligned grains and each grain is platelet-shaped with an average dimension of the shortest crystallographic axis no greater than about 500 nanometers.

The particles are aligned in a die to form a magnet body by causing them to mechanically stack with their faces adjacent one another. This results in a preferred direction of magnetization without application of a magnetic field.

Further objects and advantages of our invention will be more apparent from the detailed description which follows.

DETAILED DESCRIPTION OF THE INVENTION

Figure 1:
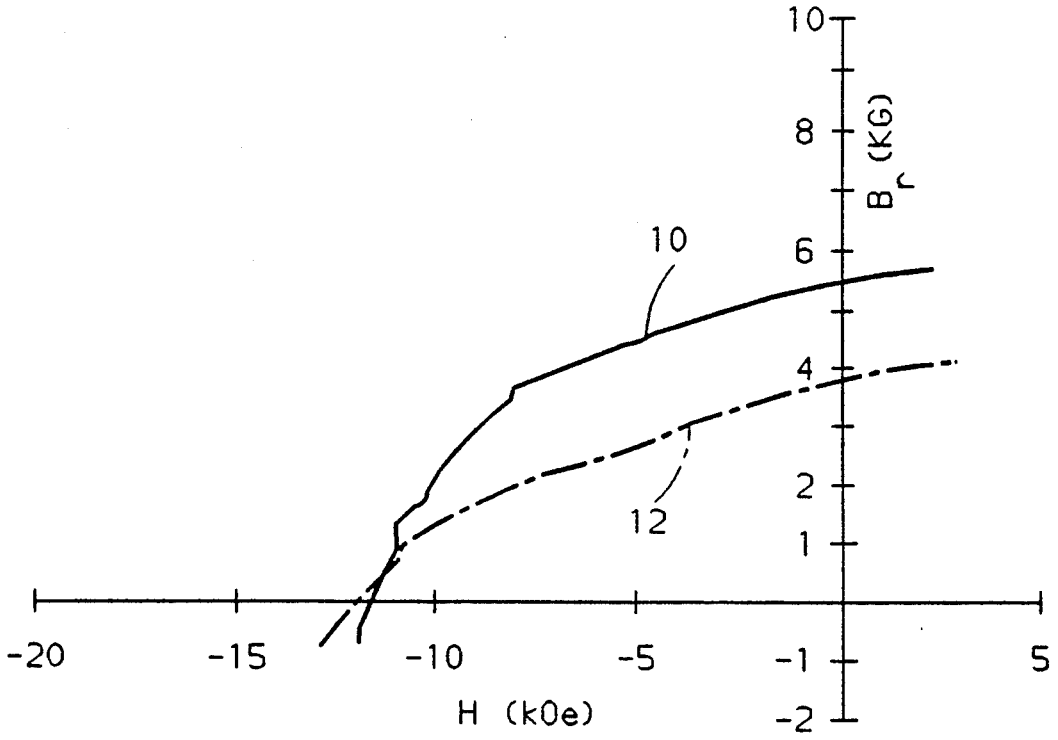
FIGS. 1 and 2 are second quadrant demagnetization curves illustrating the permanent magnet properties measured along the preferred directions of magnetization and, in the case of FIG. 1 normal thereto, for mechanically aligned anisotropic powder particles formed into a magnet body in accordance with this invention.

In the examples, alloy ingot comprising by weight 28 percent neodymium, 1.2 percent boron, and the balance iron except for small amounts of incidental impurities was obtained. This composition contained, on an atomic percent basis, 12.3 percent neodymium, 7.1 percent boron, and 80.6 percent iron. The composition was melted by induction heating under a dry, substantially oxygen-free argon atmosphere to form a uniform molten composition. While under such atmosphere and at a pressure of 2–3 psig, it was transferred into an alumina tundish and ejected down through a ceramic nozzle with a 0.6 mm orifice onto the perimeter of an 18 inch diameter copper wheel rotating with a surface velocity of about 30 meters per second. When the melt struck the copper wheel, which was at a nominal temperature of 100° F., it solidified substantially instantaneously to form ribbon fragments which were thrown from the wheel. The fragments were collected. They were substantially amorphous.

This amorphous, melt-spun iron-neodymium-boron composition was then milled to a powder which would pass through a 40 mesh screen. The powder was then heated to a temperature of about 750° C. in a die and compacted between upper and lower punches to form a flat cylindrical plug one inch in diameter by $\frac{5}{8}$ inch in thickness. While still hot, this fully densified hot-pressed body was then transferred to a larger die at 750° C. in which it was die upset to form cylindrical plug $1\frac{3}{8}$ inch in diameter by $\frac{1}{4}$ inch in thickness.

This die upset body was an unmagnetized composition that had appreciable magnetic coercivity and was magnetically anisotropic. The grains in the body were flattened and aligned with their major dimension lying transverse to the direction of pressing. The maximum dimensions of the grains were in the range of about 100 to 300 nanometers. The grains contained tetragonal crystals in which the proportions of iron, neodymium and boron were in accordance with the formula $Nd_2Fe_{14}B$. When hot pressed blocks thus prepared are magnetized in a field of 25 kiloOersteds, a permanent magnet is produced typically having a maximum energy product at room temperature of about 32 MegaGaussOersteds, a residual induction of 11.75 kiloGauss, and an intrinsic coercive force ($H_{ci}$) of 13.0 kiloOersteds. The density of the die upset body is about 7.5 g/cm$^3$.

The unmagnetized block was then comminuted at ambient temperature under argon at $1\frac{1}{2}$ inch water gauge positive pressure in a disk grinder. The powder was sieved through a 40 mesh screen and caught on a 140 mesh (about 105 micron particle size) screen. The fines were discarded.

Microscopic examination of preferred batches of particles showed them to be about 500 to 800 microns long, about 40 to 100 microns wide and about 30 to 60 microns thick. The particles looked like pieces of flagstone with roughly rectangular faces and slightly contoured surface and edges. After pressing, the resultant compact looked like a stacked flagstone fence under microscopic examination. The ratio between the shortest dimension of the face of a particle and its thickness was about 3 to 10 and for most particles about 4 to 6. The ratio of the surface area of the particles faces to their thickness was in a range of from about 300 to 3000. The high ratio between a face of each particle and its thickness is such that it can be mechanically magnetically aligned without an applied magnetic field.

Each of the powder particles consisted of many plastically deformed and aligned grains of the $Nd_2Fe_{14}B$ phase. The grains in the powder were still in the 100 to 300 nanometer size range. The particles were magnetically anisotropic with the preferred direction of magnetization along their thickness.

EXAMPLE 1

The sieved powder described above was mixed with 2 percent by weight dry epoxy powder. Ten gram samples were weighed and hand delivered to a die in a cold compaction press. The die was 0.5 inches square and the powder was compacted in the die by reciprocation of a tightly fitting punch.

The sample was pressed at about 25 psi resulting in a compact with a density of 4.7 g/cc. The compact was cured at 170° C. for ten minutes to cure the epoxy.

A cube 0.25 inch on a side was machined from the cured compact. The cube was cut so that two opposing faces were perpendicular to the direction of the motion of the punch in the die and in the direction of the crystallographic c-axes of the particles. Thus, the other two orthogonal axes of the cube were transverse to the direction of magnetic alignment of the particles in the cubic specimen.

The cube was then placed into a vibrating sample magnetometer (VSM). The cube was oriented in the VSM such that its c-axes were parallel to the direction of alignment of the field applied by the magnetometer. The sample was then magnetized to saturation and then demagnetized in the VSM. Curve 10 in the Figure of the drawing is the second quadrant demagnetization curve of the cubic sample aligned parallel to the magnetometer field. The ordinate of the graph is magnetic induction, B, in kiloGauss and the abscissa is coercivity, H, in kiloOersteds.

The sample was then reoriented in the magnetometer such that its axis of particle magnetic alignment was transverse to the magnetometer field. The sample was again magnetized to saturation and demagnetized. Curve 12 of the Figure is the demagnetization curve for the sample in a direction transverse to the direction of alignment of the particles in the cube. This experiment was repeated with the cubic sample oriented in the magnetometer with its third axis (perpendicular to opposite faces) aligned with the field of the magnetometer. Of course, in this position, the cube was still aligned with its preferred direction of magnetization transverse to the field of the magnetometer. The sample was again magnetized to saturation and demagnetized in the magnetometer. The demagnetization curve for the sample in this orientation was substantially identical to curve 12 of the drawing.

EXAMPLE 2

Figure 2:
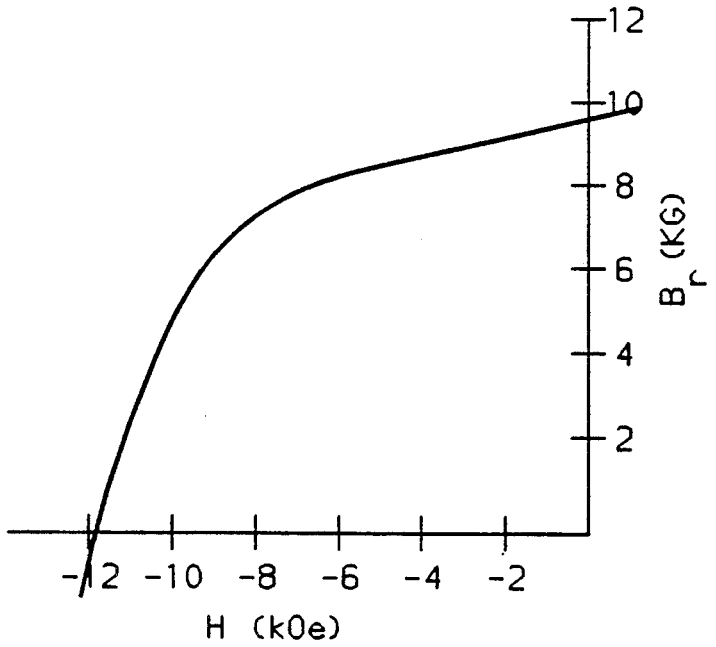

The sieved, magnetically isotropic powder described above was then heated to a temperature of about 1450° F. in a die and compacted between upper and lower punches at a pressure of 12,000 psi in an argon atmosphere to form a flat cylindrical plug one inch in diameter by ⅝ inch in thickness. After cooling, a 0.25 inch cake was cut and magnetized/demagnetized as described above in conjunction with Example 1 but only in the direction where the C-axes of the grains were parallel to the direction of alignment of the magnetic field applied by the magnetometer. FIG. 2 is the second quadrant demagnetization curve of the colin sample where the ordinate of the graph is magnetic induction B in kiloGauss and the abscissa is coercivity, H, in kiloOersteds. The curve shows a magnetic induction of approximately 9.7 KG which is about 1.5 KG above that obtained from hot-pressed isotropic powders such as result from hot pressing milled melt spun powders having the same chemical composition hence indicating that mechanical alignment in accordance with the present invention has occurred during pressing.

The Figures show that polymer-bonded and hot-pressed compacts produced by mechanical orientation of suitably sized and shaped particles of hot worked RE-TM-B alloy are magnetically anisotropic and comparable to products achieved by the more difficult process of magnetic alignment by application of a magnetic field during pressing. The polymer-bonded samples when aligned parallel to the magnetometer field had residual inductions much higher than when such samples were aligned transverse to the field of the magnetometer. The coercivities of the polymer-bonded samples at zero induction when aligned parallel to the magnetometer field were lower than their coercivity when the samples were aligned transverse to the magnetometer field. Moreover, hot-pressed samples demonstrated significantly higher magnetic induction then hot-pressed, chemically comparable, melt spun isotropic powders. Such results are characteristic of a magnetically anisotropic material and indicative that mechanical alignment does in fact occur during pressing.

In accordance with preferred practices of this invention as applied to polymer-bonded compacts, compaction pressures of about 25 to about 50 tons per square inch result in compact densities of about 4.7 and 6.1 g/cc, respectively. The density of the alloy itself is about 7.6 g/cc, which is nearly achieved when the particles are bonded together by hot pressing in the absence of a polymeric binder.

After high area-to-thickness ratio particles are produced, it is important that they be delivered into the compaction die with enough space between them to allow the particles to move into face-to-face closest stacking relation upon the application of pressure. In a production situation, it is preferred to deliver the particles from a feeder into the die so that a fairly level bed of particles results.

It might then be advantageous, for example, to use an ultrasonic transducer or other means to vibrate the particles in the die to promote the desired alignment of the particles in face-to-face relation with one another. Compaction with punch further aligns the particles and densifies the compact so that substantially all the c-axes of the crystals are parallel to one another, i.e. magnetic anisotropy is created in the body by mechanical alignment of the powder. It also prevents further relative motion of the particles and magnetic misalignment during bonding, magnetic alignment, installation in an assembly, etc.

Such particles could also be finally isostatically compacted to a high density compact provided they were first mechanically oriented by vibration or lower pressure directional compaction.

While our invention has been described in terms of a preferred embodiment thereof, it will be appreciated that other forms could readily be adapted by those skilled in the art. Accordingly, our invention is to be considered limited only by the following claims.

The embodiments of the invention in which an exclusive property or privilege is claimed are defined as follows:

1. A method of making a magnetically anisotropic bonded magnet comprising particles of a composition that has as its magnetic constituent the tetragonal crystal phase $RE_2TM_{14}B$ such that the particles have an intrinsic coercivity at room temperature of at least 1,000 Oersteds, said method comprising:

providing a hot worked body comprising plastically deformed, platelet-shaped grains of said phase in which body the grains are aligned and have an average smallest dimension no greater than about 500 nanometers, the composition of said body comprising, on an atomic percent basis, about 40 to 90 percent transition metal (TM) taken from the group consisting of iron and mixtures of iron and cobalt such that iron makes up at least 40 percent of the total composition, about 10 to 40 percent rare earth metal (RE) such that at least about 6 percent of the total composition is neodymium and/or praseodymium, and at least 0.5 percent boron, comminuting said body to form platelet-shaped particles having relatively large faces on opposites sides thereof and a relatively small thickness between said faces wherein the ratio between the area of a said face (expressed in square microns) and said thickness (expressed in microns) is greater than about 300:1 and said particles have a preferred magnetic orientation normal to said faces;

delivering said particles to a die such that they can move sufficiently to align face-to-face upon the application of suitable mechanical force, and in the absence of an external particle-aligning magnetic field, applying pressure to said particles to cause face-to-face alignment thereof and prevent further relative motion of the particles.

2. The method of claim 1 including a step of mixing the particles with a polymeric binder prior to the application of said pressure.

3. The method of claim 1 including a step of mixing the particles with a heat-curable dry epoxy resin prior to the application of said pressure.

4. A method of making a magnetically anistropic bonded magnet comprising platelets of predominantly tetragonal crystal phase $RE_2TM_{14}B$ wherein the platelets prior to bonding have an intrinsic coercivity at room temperature of at least 1,000 Oersteds, said method comprising:

providing a hot worked body comprising plastically deformed, platelet-shaped grains of said phase in which body the grains are aligned and have an average smallest dimension no greater than about 500 nanometers, the composition of said body comprising, on an atomic percent basis, about 40 to 90 percent transition metal (TM) taken from the group consisting of iron and mixtures of iron and cobalt such that iron makes up at least 40 percent of the total composition, about 10 to 40 percent rare earth metal (RE) such that at least about 6 percent of the total composition is neodymium and/or praseodymium, and at least 0.5 percent boron, comminuting said body to form platelets which have a substantially rectangular shaped face and a preferred magnetic orientation normal to said face and wherein the shortest dimension of said face is at least about 40 microns and the average thickness of said platelet is less than 40 microns;

delivering said platelets to a die such that they can move sufficiently to align face-to-face upon the application of suitable mechanical force, and in the absence of an external particle-aligning magnetic filed, aligning pressure to said particles to cause face-to-face packing and magnetic alignment thereof and to prevent further relative motion of the particles.

5. A method of making a magnetically anistropic bonded magnet comprising high aspect ratio particles of hot worked rapidly solidified alloy which alloy is comprised predominantly of the tetragonal crystal phase $RE_2TM_{14}B$ such that the particles have an intrinsic coercivity at room temperature of at least 1,000 Oersteds, said method comprising:

comminuting said hot worked alloy to form particles which have a substantially rectangular shaped face the shortest dimension of said face being larger than the average thickness of the particles;

delivering said particles to a die such that they are spaced sufficiently apart to provide for movement therebetween and align face to face upon the application of suitable mechanical pressure, and applying pressure to said particles to cause face-to face packing and magnetic alignment thereof without the influence of an external particle-aligning magnetic field and to prevent further relative motion of the particles.

6. The method of claim 5 wherein the alloy contains at least about 6 atomic percent of one or more taken from the group of neodymium and praseodymium and at least about 40 atomic percent iron or mixtures of at least about 40 atomic percent iron with lesser amounts of cobalt.

7. The method of claim 5 wherein the pressure is applied by the stroke of a punch in a cold compaction press.

8. The method of claim 5 including a step of mixing the particles with a polymeric binder prior to the application of said pressure.

9. The method of claim 5 including a step of mixing the particles with a heat-curable dry epoxy resin prior to the application of said pressure.

10. A method of making a magnetically anistropic magnet comprising a plurality of anistropic platelets bonded together in face-to-face relation, said platelets each having a room temperature intrinsic coercivity of at least 1000 Oersteds and comprising a plurality of plastically deformed and aligned platelet-shaped grains of the tetragonal crystal phase $RE_2TM_{14}B$ including the steps of:

hot working a body of RE-TM-B alloy-containing grains of said crystal phase so as to plastically deform and align said grains in said body and such that grains in said body have an average smallest dimension no greater than about 500 nanometers, said alloy comprising an atomic basis, about 40–90 percent transition metal (TM) taken from the group consisting of iron and mixtures of iron and cobalt such that iron makes up at least 40 percent of the total composition, about 10 to 40 percent rare earth metal (RE) such that at least about six percent of the total composition is neodymium and/or praseodymium, and at least 0.5 percent boron;

comminuting said body into a plurality of platelets each having opposing faces spaced one from the other by the thickness of said platelet and a preferred magnetic orientation normal to said faces wherein the ratio between the surface area of one such face (expressed in square microns) and said thickness (expressed in microns) is greater than about 300:1;

placing said platelets in a die such that they can move sufficient to align themselves in face-to-face relation upon the application of suitable pressure thereto; and applying pressure to said platelet in the absence of an external platelet aligning magnetic field so as to mechanically align said platelets in said face-to-face relation and to prevent further relative motion therebetween.

11. The method according to claim 10 including a step of mixing said platelets with a polymeric binder prior to the application of said pressure.

12. The method according to claim 11 wherein said binder comprises a heat curable, dry epoxy resin.

* * * * *